US012121134B2

(12) United States Patent
Koike

(10) Patent No.: US 12,121,134 B2
(45) Date of Patent: Oct. 22, 2024

(54) BACKPACK-TYPE ASSEMBLY

(71) Applicant: MAKITA CORPORATION, Anjo (JP)

(72) Inventor: Yoichiro Koike, Anjo (JP)

(73) Assignee: MAKITA CORPORATION, Anjo (JP)

( * ) Notice: Subject to any disclaimer, the term of this patent is extended or adjusted under 35 U.S.C. 154(b) by 139 days.

(21) Appl. No.: 17/954,538

(22) Filed: Sep. 28, 2022

(65) Prior Publication Data

US 2023/0111737 A1 Apr. 13, 2023

(30) Foreign Application Priority Data

Oct. 7, 2021 (JP) ..... 2021-165460

(51) Int. Cl.
*A45F 3/04* (2006.01)
*A45F 3/12* (2006.01)

(52) U.S. Cl.
CPC ..... *A45F 3/04* (2013.01); *A45F 3/12* (2013.01); *A45F 2003/045* (2013.01); *A45F 2003/125* (2013.01)

(58) Field of Classification Search
CPC ..... A45F 2003/125; A45F 2003/122; A45F 3/04; A45F 2003/045; A45F 2003/127; A45F 3/12; F42F 2221/38; F04D 25/08; A41D 13/005
See application file for complete search history.

(56) References Cited

U.S. PATENT DOCUMENTS

| | | | | |
|---|---|---|---|---|
| 6,702,167 | B2 * | 3/2004 | Annis | A61M 1/06 604/35 |
| 8,225,974 | B2 * | 7/2012 | Zheng | A45F 3/08 224/628 |
| 9,851,113 | B2 * | 12/2017 | Clemente | A41D 13/0056 |
| 10,064,476 | B2 * | 9/2018 | Vierthaler | A45F 3/10 |
| 10,499,722 | B2 * | 12/2019 | Squires | A45F 3/04 |
| 10,555,594 | B2 * | 2/2020 | Tai | A45F 3/04 |
| 10,892,449 | B2 * | 1/2021 | Yamaoka | A45F 3/10 |
| 11,793,377 | B2 | 10/2023 | Tahara et al. | |
| 2005/0017041 | A1 * | 1/2005 | Roberts | A45F 3/04 224/642 |

(Continued)

FOREIGN PATENT DOCUMENTS

| | | | |
|---|---|---|---|
| CN | 201319950 Y | * | 10/2009 |
| JP | 2021-109303 A | | 8/2021 |

(Continued)

OTHER PUBLICATIONS

CN-201319950-Y with translation (Year: 2009).*
WO-2018034766-A1 with translation (Year: 2018).*
Apr. 15, 2024 Office Action issued in U.S. Appl. No. 17/954,772.

*Primary Examiner* — Adam J Waggenspack
(74) *Attorney, Agent, or Firm* — Oliff PLC

(57) ABSTRACT

A backpack-type assembly may include: a body; and a base member. The body may include a cooling fan. The base member may include: a back plate attached to the body; and a harness attached to the back plate and configured to be worn on a user. The harness may include: a cooling port; and at least one shoulder belt configured to be worn on a shoulder of the user. The cooling fan may be configured to circulate cooling air into or out of the base member through the cooling port of the harness.

11 Claims, 10 Drawing Sheets

(56) References Cited

U.S. PATENT DOCUMENTS

| | | | | |
|---|---|---|---|---|
| 2012/0286718 | A1 | 11/2012 | Richards | |
| 2018/0146807 | A1 | 5/2018 | Silver et al. | |
| 2019/0226702 | A1 | 7/2019 | Nolan et al. | |
| 2019/0231054 | A1* | 8/2019 | Walter | A01K 97/125 |
| 2020/0196737 | A1 | 6/2020 | Chan | |
| 2021/0267357 | A1* | 9/2021 | Steffen | B25F 5/00 |
| 2023/0110242 | A1 | 4/2023 | Koike | |

FOREIGN PATENT DOCUMENTS

| | | | |
|---|---|---|---|
| KR | 20-2010-0006694 | U | 7/2010 |
| KR | 10-2533422 | B1 | 5/2023 |
| WO | WO-2018034766 | A1 * | 2/2018 |
| WO | 2020/147474 | A1 | 7/2020 |

* cited by examiner

BACKPACK-TYPE ASSEMBLY

CROSS-REFERENCE TO RELATED APPLICATION

This application claims priority to Japanese Patent Application No. 2021-165460, filed on Oct. 7, 2021, the entire contents of which are hereby incorporated by reference into the present application.

TECHNICAL FIELD

The disclosure herewith relates to a backpack-type assembly.

BACKGROUND

Japanese Patent Application Publication NO. 2021-109303 describes a backpack-type assembly. The backpack-type assembly includes a body and a base member. The base member includes a back plate attached to the body, and a harness attached to the back plate and configured to be worn on a user. The harness includes at least one shoulder belt configured to be worn on a shoulder of the user.

SUMMARY

When the user wears the backpack-type assembly as above on his/her back, heat may build up at a portion of the base member where it contacts the user's body, and the user might therefore feel hot. The description herein discloses an art for avoiding a situation in which a user feels heat while the user is wearing a backpack-type assembly on his/her back.

A backpack-type assembly disclosed herein may comprise: a body; and a base member. The body may comprise a cooling fan. The base member may comprise: a back plate attached to the body; and a harness attached to the back plate and configured to be worn on a user. The harness may comprise: a cooling port; and at least one shoulder belt configured to be worn on a shoulder of the user. The cooling fan may be configured to circulate cooling air into or out of the base member through the cooling port of the harness.

According to the above configuration, the user's body can be cooled by operating the cooling fan while the user is wearing the backpack-type assembly. Due to this, an occurrence of a situation in which the user feels heat while the user is wearing the backpack-type assembly on his/her back can be suppressed.

DETAILED DESCRIPTION

Figure 1:
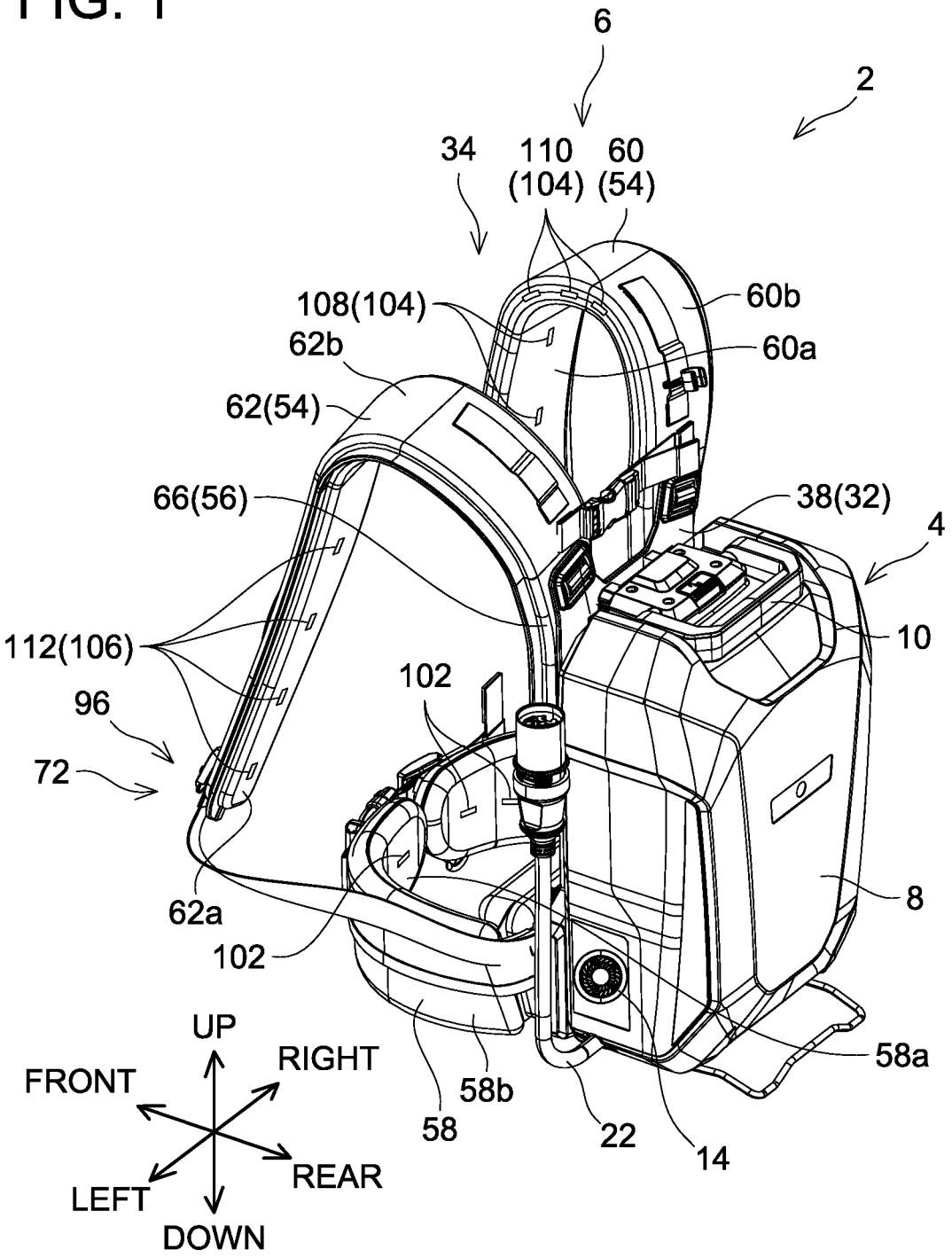
FIG. 1 is a perspective view of a backpack-type assembly 2 of a first embodiment.

Representative, non-limiting examples of the present disclosure will now be described in further detail with reference to the attached drawings. This detailed description is merely intended to teach a person of skill in the art further details for practicing preferred aspects of the present teachings and is not intended to limit the scope of the present disclosure. Furthermore, each of the additional features and teachings disclosed below may be utilized separately or in conjunction with other features and teachings to provide improved backpack-type assemblies, as well as methods for using and manufacturing the same.

Moreover, combinations of features and steps disclosed in the following detailed description may not be necessary to practice the present disclosure in the broadest sense, and are instead taught merely to particularly describe representative examples of the present disclosure. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In one or more embodiments, the cooling port may be disposed in vicinity of the user when the user wears the harness.

According to the above configuration, when the cooling air circulates through the cooling port, the cooling air flows in the vicinity of the user's body. Due to this, an occurrence of a situation in which the user feels heat while the user is wearing the backpack-type assembly on his/her back can be suppressed.

In one or more embodiments, the cooling port may face the user when the user wears the harness.

According to the above configuration, when the cooling air circulates through the cooling port, the cooling air flows along user's body surface. Due to this, the occurrence of the situation in which the user feels heat while the user is wearing the backpack-type assembly on his/her back can be suppressed.

In one or more embodiments, the harness may further comprise a back pad configured to be in contact with a back of the user when the user wears the harness. The cooling port may face a portion of the back of the user being in contact with the back pad when the user wears the harness.

When the harness has the back pad, the back pad comes into contact with the user's back. Due to this, heat may easily build up on the user's back. According to the above configuration, when the cooling air circulates through the cooling port, the cooling air flows along a surface of a part of the user's back that is in contact with the back pad. Due to this, the occurrence of the situation in which the user feels heat while the user is wearing the backpack-type assembly on his/her back can further be suppressed.

In one or more embodiments, the harness may further comprise a back pad configured to be in contact with a back of the user when the user wears the harness. A non-contacting space may be defined between the back of the user and the back plate when the user wears the harness, the non-contacting space being a space in which the back pad is not disposed. The cooling port may face the non-contacting space when the user wears the harness.

When the harness has the back pad, the back pad comes into contact with the user's back. Due to this, heat may easily build up on the user's back. According to the above configuration, when the cooling air circulates through the cooling port, the cooling air flows along the surface of the user's back in the non-contacting space. Due to this, the occurrence of the situation in which the user feels heat while the user is wearing the backpack-type assembly on his/her back can further be suppressed.

In one or more embodiments, the cooling port may be disposed on the shoulder belt.

Since the shoulder belt comes into contact with the user's shoulder when the user wears the backpack-type assembly on his/her back, heat may easily build up on the user's shoulder. According to the above configuration, when the cooling air circulates through the cooling port, the cooling air flows along a surface of the user's shoulder. Due to this, the occurrence of the situation in which the user feels heat while the user is wearing the backpack-type assembly on his/her back can further be suppressed.

In one or more embodiments, the harness may further comprise a waist belt configured to be worn on a waist of the user. The cooling port may be disposed on the waist belt.

When the harness has the waist belt, the waist belt comes into contact with the user's waist. Due to this, heat may easily build up on the user's waist. According to the above configuration, when the cooling air circulates through the cooling port, the cooling air flows along a surface of the user's waist. Due to this, the occurrence of the situation in which the user feels heat while the user is wearing the backpack-type assembly on his/her back can further be suppressed.

In one or more embodiments, the harness may further comprise: a waist belt configured to be worn on a waist of the user; and a cooling port disposed on the waist belt. The cooling fan may be configured to circulate the cooling air into or out of the base member through the cooling port disposed on the shoulder belt and the cooling port disposed on the waist belt.

When the harness has the waist belt, the waist belt comes into contact with the user's waist. Due to this, heat may easily build up on the user's waist. According to the above configuration, when the cooling air circulates through the cooling port, the cooling air flows along a surface of the user's waist. Due to this, an occurrence of a situation in which the user feels heat while the user is wearing the backpack-type assembly on his/her back can further be suppressed.

In one or more embodiments, the body may comprise a battery configured to supply electrical power to the cooling fan.

According to the above configuration, the cooling fan can be operated even when the backpack-type assembly does not have an external power supply for supplying electrical power to the cooling fan.

In one or more embodiments, the body may be configured to be connected to an electrical working machine comprising a motor. The battery may be configured to supply electrical power to the motor of the electrical working machine.

According to the above configuration, the situation in which the user feels heat while the user is wearing the backpack-type assembly which supplies electrical power to the electrical working machine can be suppressed.

In one or more embodiments, the cooling fan may be configured so that a flow rate of the cooling fan is adjustable.

According to the above configuration, the flow rate of the cooling fan can be adjusted in accordance with a degree of heat which the user feels.

In one or more embodiments, the body may comprise an operating part configured to operate the cooling fan.

According to the above configuration, the user can control operation of the cooling fan using the operating part.

In one or more embodiments, the operating part may comprise a shifter switch configured to switch an OFF state and an ON state of the cooling fan.

According to the above configuration, the user can cause the cooling fan to operate by manipulating the shifter switch when the user wishes to cause the cooling fan to operate.

In one or more embodiments, the cooling fan may be configured so that a flow rate of the cooling fan is adjustable. The operating part may comprise a flow rate adjusting switch configured to adjust the flow rate of the cooling fan.

According to the above configuration, the user can adjust the flow rate of the cooling fan to a desired flow rate by manipulating the flow rate adjusting switch.

In one or more embodiments, the harness may comprise an air passage communicating with the cooling port. Cooling air may flow in the air passage when the cooling fan operates.

According to the above configuration, the harness can be cooled by the cooling air flowing to the air passage. Due to this, the occurrence of the situation in which the user feels heat while the user is wearing the backpack-type assembly on his/her back can be suppressed.

First Embodiment

A backpack-type assembly 2 of an embodiment will be described with reference to FIGS. 1 to 5. The backpack-type assembly 2 is used by being worn on a user's back. Hereinbelow, a direction that perpendicularly intersects the user's back when the backpack-type assembly 2 is worn by the user will be termed a front-rear direction, a direction that perpendicularly intersects the front-rear direction will be termed an up-down direction, and a direction that perpendicularly intersects the front-rear and up-down directions will be termed a left-right direction.

As shown in FIG. 1, the backpack-type assembly 2 comprises a body 4 and a base member 6. The body 4 is detachably attached to the base member 6. In the present embodiment, the body 4 is a large-sized, backpack-type power supply device. The body 4 may for example be 5 to 10 kg. Electrical power can be supplied from an external charging source to the body 4 through a power supply (not shown) connected to the body 4. The body 4 is configured to be connected via a connection cable 22 to an electrical working machine (not shown) having a motor, and is configured to supply electrical power discharge to the motor. The user can wear the backpack-type assembly 2 on his/her back and work while holding the electrical working machine by hands. By using the backpack-type assembly 2, the user can use the electrical working machine over a long period of time.

Figure 2:
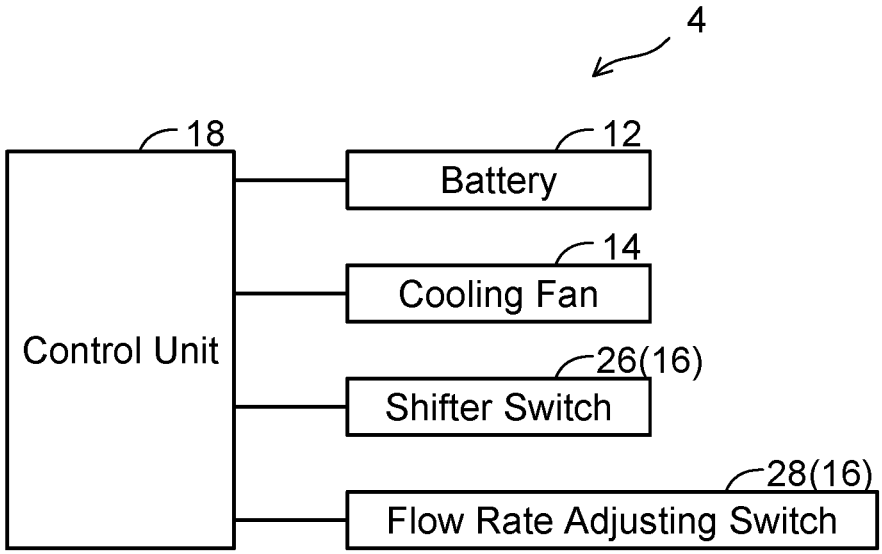
FIG. 2 is a block diagram of a body 4 of the first embodiment.

The body 4 comprises a body casing 8, a handle 10, a battery 12 (see FIG. 2), a cooling fan 14, an operating part 16 (see FIG. 4), and a control unit 18 (see FIG. 2). The handle 10 is rotatably arranged at an upper portion of the body casing 8. In a state where the user is not wearing the backpack-type assembly 2 on his/her back, the handle 10 can be gripped by the user. The user can easily carry the body 4 by gripping the handle 10 and detaching the body 4 from the base member 6.

The battery 12 shown in FIG. 2 is housed inside the body casing 8. The battery 12 may for example be a rechargeable secondary battery. Electrical power from the battery 12 is supplied to an electrical working machine (not shown) with a motor through a connection cable 22.

As shown in FIG. 1, the cooling fan 14 is attached to a lower portion of a left surface of the body casing 8. The cooling fan 14 may for example be an axial fan. The cooling fan 14 is configured to operate on electrical power supplied from the battery 12.

Figure 4:
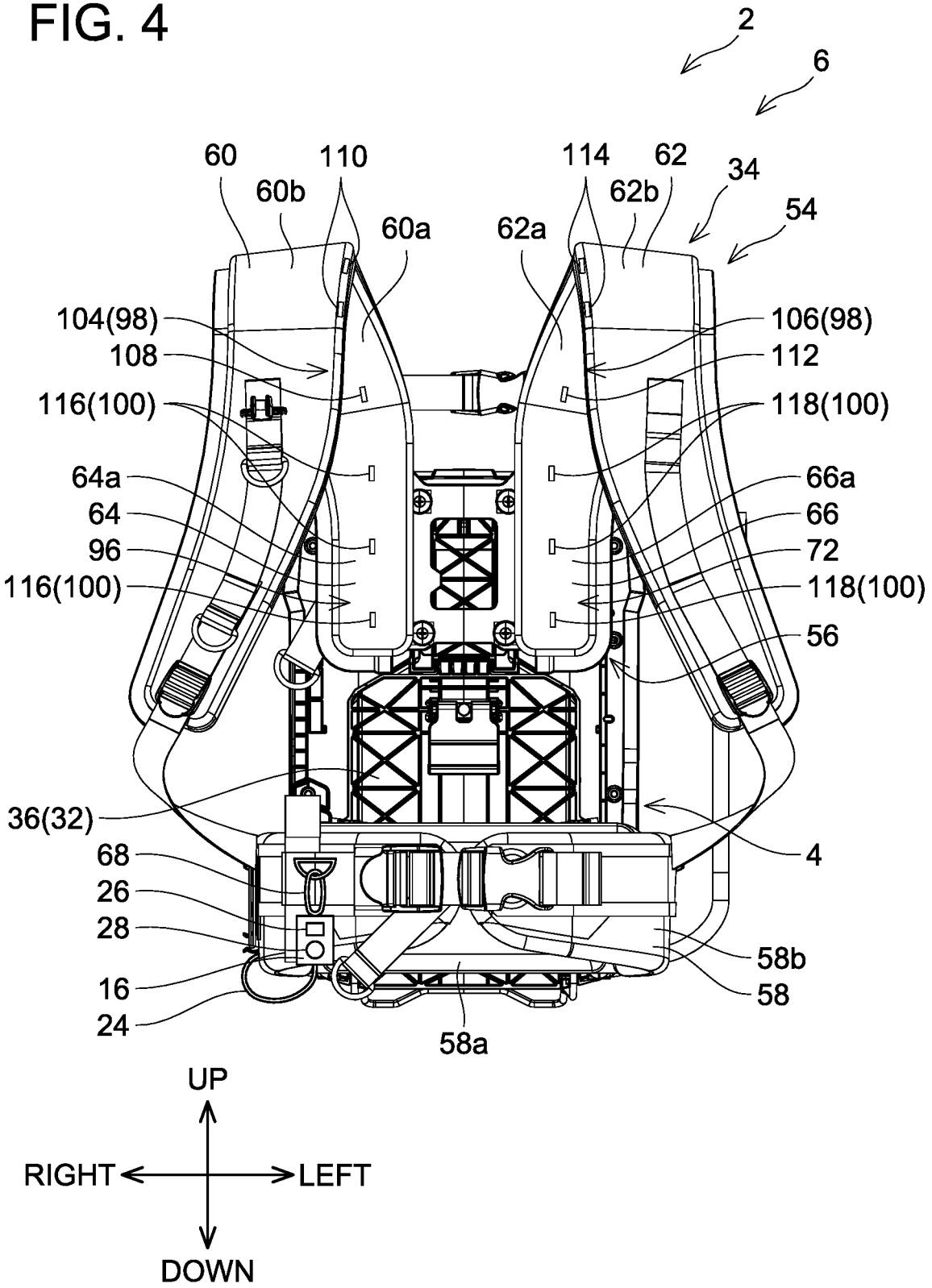
FIG. 4 is a front view of the base member 6 of the first embodiment.

As shown in FIG. 4, the operating part 16 is attached to the body casing 8 via a connection cable 24. The operating part 16 includes a shifter (on/off) switch 26 and a flow rate adjusting switch 28. The shifter switch 26 is configured to switch an ON state and an OFF state of the cooling fan 14. The flow rate adjusting switch 28 is configured to adjust a flow rate of the cooling fan 14. The flow rate adjusting switch 28 may for example be configured to switch between a HIGH mode with a high flow rate and a LOW mode with a low flow rate.

The control unit 18 shown in FIG. 2 is housed inside the body casing 8. The control unit 18 is configured to supply the electrical power of the battery 12 to the cooling fan 14 in accordance with signals supplied from the shifter switch 26 and the flow rate adjusting switch 28.

Figure 3:
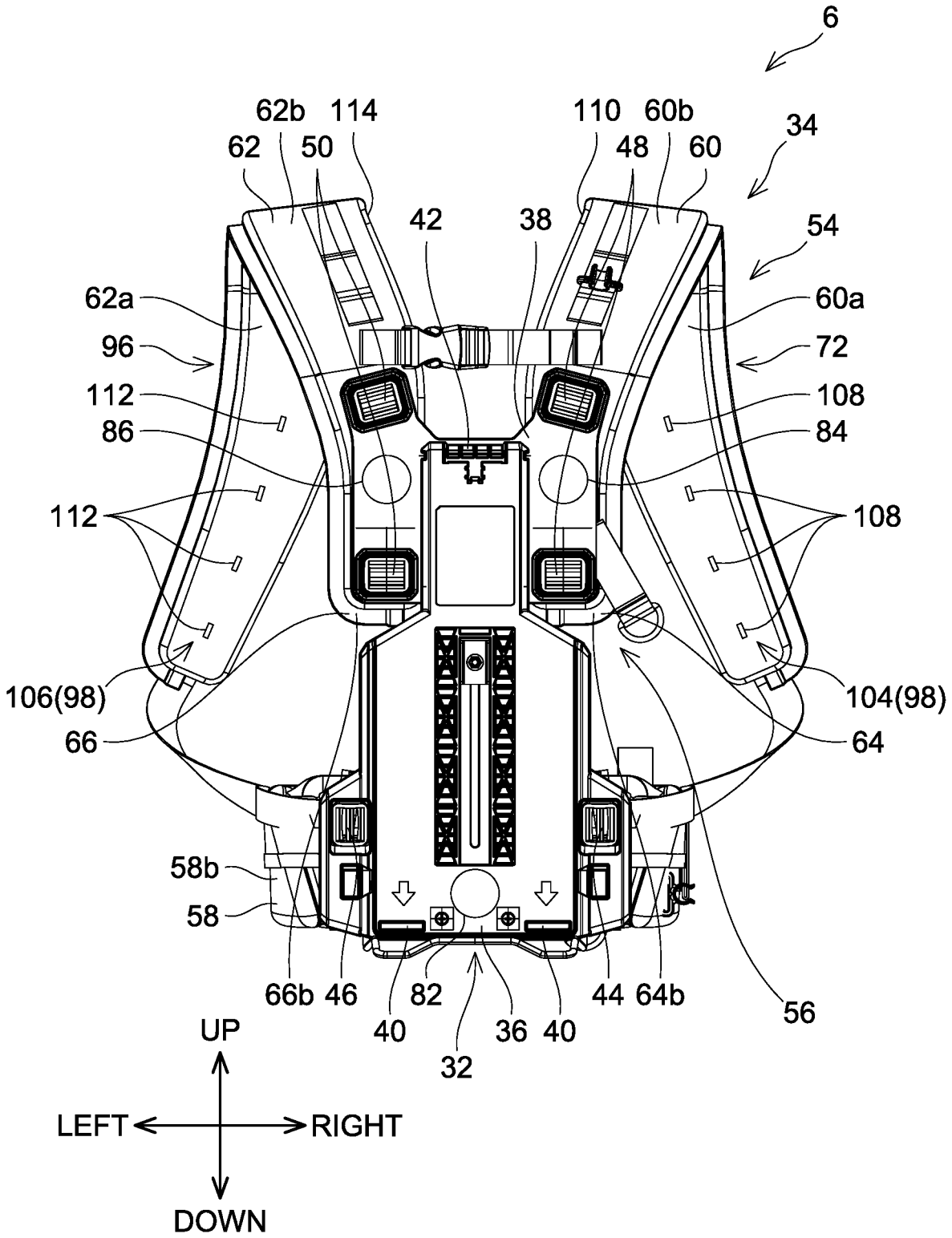
FIG. 3 is a back view of a base member 6 of the first embodiment.

As shown in FIG. 3, the base member 6 comprises a back plate 32 and a harness 34. The body 4 (see FIG. 1) is detachably attached to the back plate 32. The back plate 32 comprises a first back plate 36 and a second back plate 38.

The first back plate 36 comprises two lower engaging portions 40, one upper engaging portion 42, a right attaching portion 44, and a left attaching portion 46. The two lower engaging portions 40 are disposed in vicinity of a lower end of the first back plate 36. The one upper engaging portion 42 is disposed in vicinity of an upper end of the first back plate 36. In a state where the body 4 (see FIG. 1) is attached to the back plate 32, the two lower engaging portions 40 and the one upper engaging portion 42 engage with a front surface of the body casing 8 (see FIG. 1). The right attaching portion 44 is disposed in vicinity of a right end of a lower portion of the first back plate 36. The left attaching portion 46 is disposed in vicinity of a left end of the lower portion of the first back plate 36.

The second back plate 38 is attached to an upper portion of the first back plate 36 from a front side. The second back plate 38 protrudes to both right and left sides from the upper portion of the first back plate 36. The second back plate 38 comprises two right attaching portions 48 and two left attaching portions 50. The two right attaching portions 48 are disposed to the right of the upper portion of the first back plate 36, and the two left attaching portions 50 are disposed to the left of the upper portion of the first back plate 36.

As shown in FIG. 4, the harness 34 is detachably attached to the back plate 32. The harness 34 is used by being worn by the user. The harness 34 comprises at least one shoulder belt 54 (two in the present embodiment), at least one back pad 56 (two in the present embodiment), and a waist belt 58.

The shoulder belts 54 are constituted of a breathable fabric material that is capable of permeating moisture. The two shoulder belts 54 include a right shoulder belt 60 and a left shoulder belt 62. When the harness 34 is worn by the user, the right shoulder belt 60 is worn on the user's right shoulder, and the left shoulder belt 62 is worn on the user's left shoulder. In this state, a contact surface 60*a* of the right shoulder belt 60 contacts the user's right shoulder, and a contact surface 62*a* of the left shoulder belt 62 contacts the user's left shoulder.

The back pads 56 are constituted of a breathable fabric material that is capable of permeating moisture. The two back pads 56 include a right back pad 64 and a left back pad 66. When the harness 34 is worn by the user, a contact surface 64*a* of the right back pad 64 contacts an upper right portion of the user's back, and a contact surface 66*a* of the left back pad 66 contacts an upper left portion of the user's back. The right back pad 64 is integrated with the right shoulder belt 60. The left back pad 66 is integrated with the left shoulder belt 62.

As shown in FIG. 3, the right back pad 64 is detachably attached to the second back plate 38 via the two right attaching portions 48 of the second back plate 38. A distal end of the right shoulder belt 60 is detachably attached to the first back plate 36 via the right attaching portion 44 of the first back plate 36. The left back pad 66 is detachably attached to the second back plate 38 via the two left attaching portions 50 of the second back plate 38. A distal end of the left shoulder belt 62 is detachably attached to the first back plate 36 via the left attaching portion 46 of the first back plate 36.

The waist belt 58 shown in FIG. 4 is constituted of a breathable fabric material that is capable of permeating moisture. The waist belt 58 is detachably attached to the lower portion of the first back plate 36. When the harness 34 is worn by the user, the waist belt 58 is worn on the user's waist. In this state, a contact surface 58*a* of the waist belt 58 contacts the user's waist. Further, the waist belt 58 has the operating part 16 detachably attached thereto via a buckle 68.

When the user works in a state of wearing the backpack-type assembly 2 on his/her back, heat easily builds up at contacting portion(s) between the user's body and the harness 34. Due to this, the user may feel heat during the work. The backpack-type assembly 2 of the present embodiment comprises a cooling structure 72 for cooling the user's body.

Figure 5:
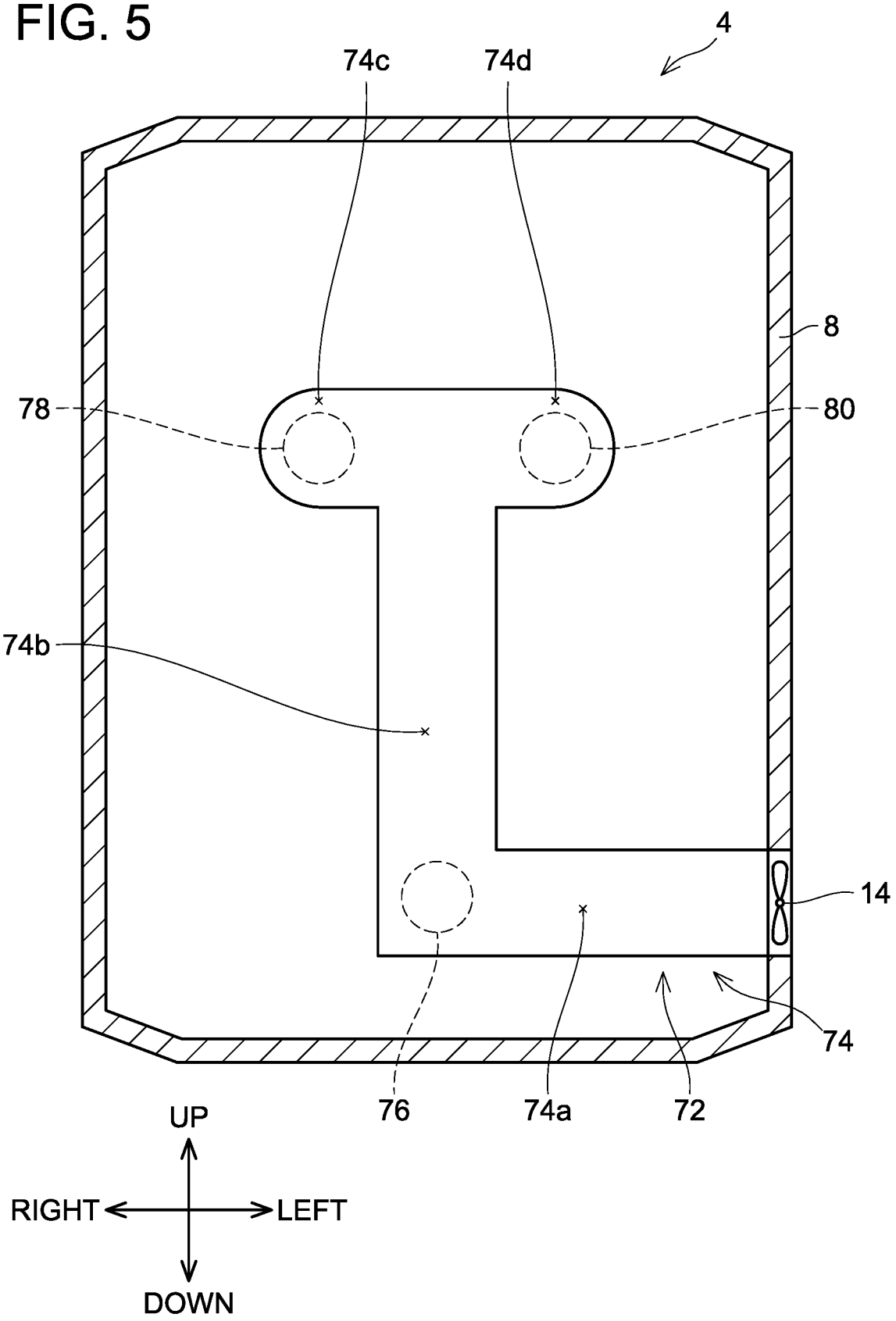
FIG. 5 is a cross-sectional view of the body 4 of the first embodiment.

As shown in FIG. 5, the cooling structure 72 comprises a cooling fan 14, a body passage 74, and body communication holes 76, 78, 80. The cooling fan 14, the body passage 74, and the body communication holes 76, 78, 80 are disposed on the body 4. The body passage 74 is defined inside the body casing 8. The body passage 74 includes a lower passage 74*a* extending rightward from the cooling fan 14, a center passage 74*b* extending upward from a right end of the lower passage 74*a*, a right branching passage 74*c* extending rightward from an upper end of the center passage 74*b*, and a left branching passage 74*d* extending leftward from the upper end of the center passage 74*b*. The body communication hole 76 is defined in vicinity of a connecting point between the lower passage 74*a* and the center passage 74*b*.

The body communication hole 78 is defined in the right branching passage 74*c*. The body communication hole 80 is defined in the left branching passage 74*d*. The body communication holes 76, 78, 80 penetrate a front surface of the body casing 8. The front surface of the body casing 8 is a surface that faces the back plate 32 (see FIG. 3) when the body 4 is attached to the base member 6 (see FIG. 3).

As shown in FIG. 3, the cooling structure 72 further includes back plate communication holes 82, 84, 86. The back plate communication hole 82 penetrates the first back plate 36 in its thickness direction (front-rear direction). Each of the back plate communication holes 84, 86 penetrates the second back plate 38 in its thickness direction (front-rear direction). The back plate communication hole 84 is disposed between the two right attaching portions 48. The back plate communication hole 86 is disposed between the two left attaching portions 50. When the body 4 (see FIG. 5) is attached to the base member 6, the back plate communication hole 82 is connected to the body communication hole 76 (see FIG. 5), the back plate communication hole 84 is connected to the body communication hole 78 (see FIG. 5), and the back plate communication hole 86 is connected to the body communication hole 80 (see FIG. 5).

Figure 6:
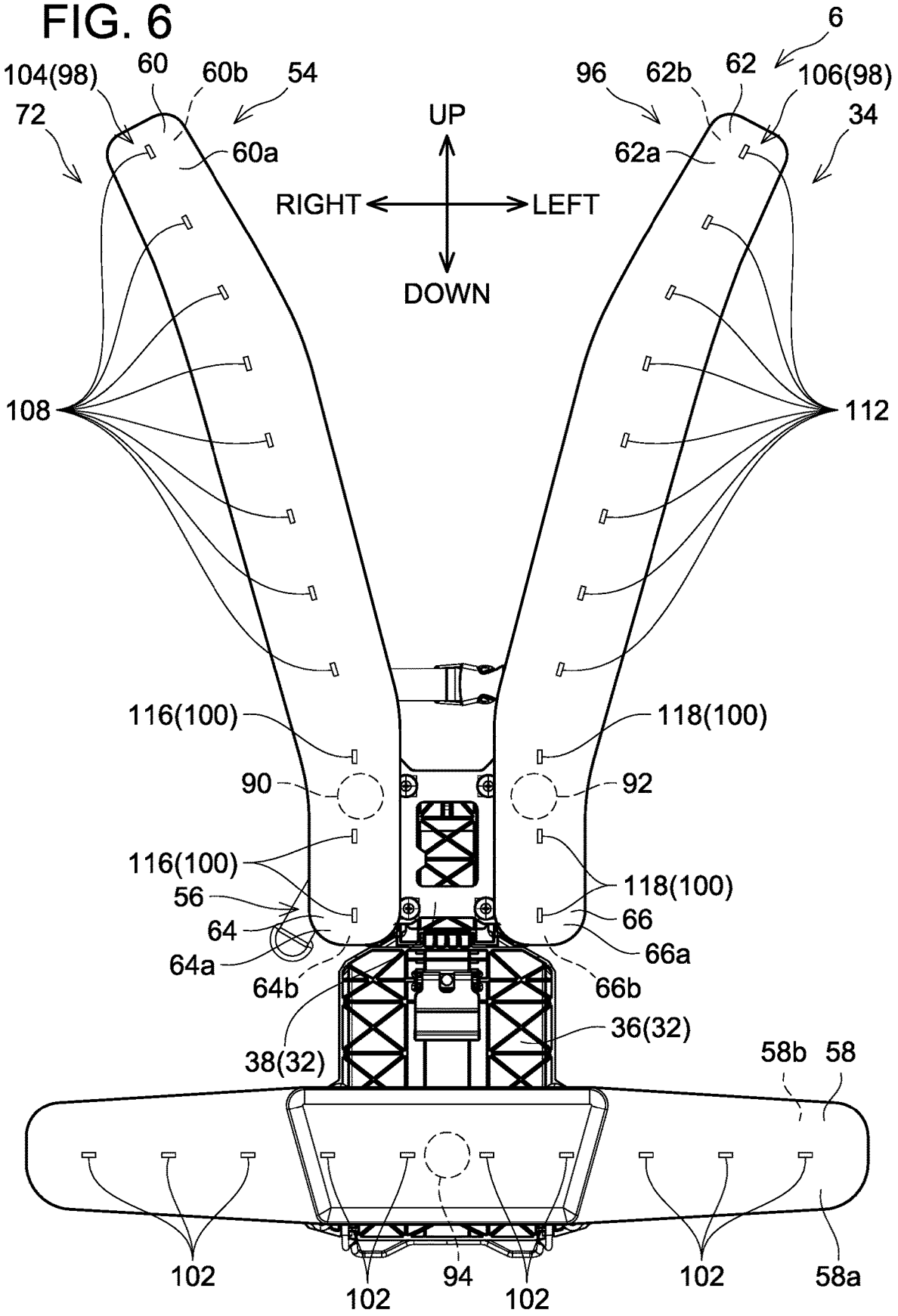
FIG. 6 is a front view of the base member 6 of the first embodiment in a state where shoulder belts 54 and a waist belt 58 are spread open.

As shown in FIG. 6, the cooling structure 72 further includes harness communication holes 90, 92, 94 and a plurality of cooling ports 96. Although the harness communication holes 90, 92, 94 are not visible by being hidden, the harness communication holes 90, 92, 94 are indicated in FIG. 6 by broken lines. The harness communication hole 90 is defined in a non-contacting surface 64*b* of the right back pad 64 (see FIG. 7). The non-contacting surface 64*b* of the right back pad 64 is a surface that does not contact the user's back when the right back pad 64 is in contact with the user's back, and is a surface on an opposite side from the contact surface 64*a* of the right back pad 64. The harness communication hole 92 is defined in a non-contacting surface 66*b* of the left back pad 66. The non-contacting surface 66*b* of the left back pad 66 (see FIG. 7) is a surface that does not contact the user's back when the left back pad 66 is in contact with the user's back, and is a surface on an opposite side from the contact surface 66*a* of the left back pad 66. The harness communication hole 94 is defined in a non-contacting surface 58*b* of the waist belt 58. The non-contacting surface 58*b* of the waist belt 58 is a surface that does not contact the user's waist when the waist belt 58 is worn on the user's waist, and is a surface on an opposite side from the contact surface 58*a* of the waist belt 58 in contact with the user's back. When the body 4 (see FIG. 5) is attached to the base member 6, the harness communication hole 90 is connected to the back plate communication hole 84 (see FIG. 3), the harness communication hole 92 is connected to the back plate communication hole 86 (see FIG. 3), and the harness communication hole 94 is connected to the back plate communication hole 82 (see FIG. 3).

The plurality of cooling ports 96 includes one or more shoulder cooling ports 98, one or more back cooling ports 100, and one or more waist cooling ports 102 (ten in the present embodiment). The one or more shoulder cooling ports 98 include one or more right shoulder cooling ports 104 and one or more left shoulder cooling ports 106.

The right shoulder cooling ports 104 are disposed on the right shoulder belt 60. The one or more right shoulder cooling ports 104 include one or more first right shoulder cooling ports 108 (eight in the present embodiment) and one or more second right shoulder cooling ports 110 (three in the present embodiment; see FIG. 7). The eight first right shoulder cooling ports 108 are disposed on the contact surface 60*a* of the right shoulder belt 60. The eight first right shoulder cooling ports 108 are arranged in a line along the longitudinal direction of the contact surface 60*a* of the right shoulder belt 60. When the right shoulder belt 60 is worn on the user's right shoulder, the eight first right shoulder cooling ports 108 face (i.e., are directed toward) the user's right shoulder in vicinity of the user's right shoulder.

Figure 7:
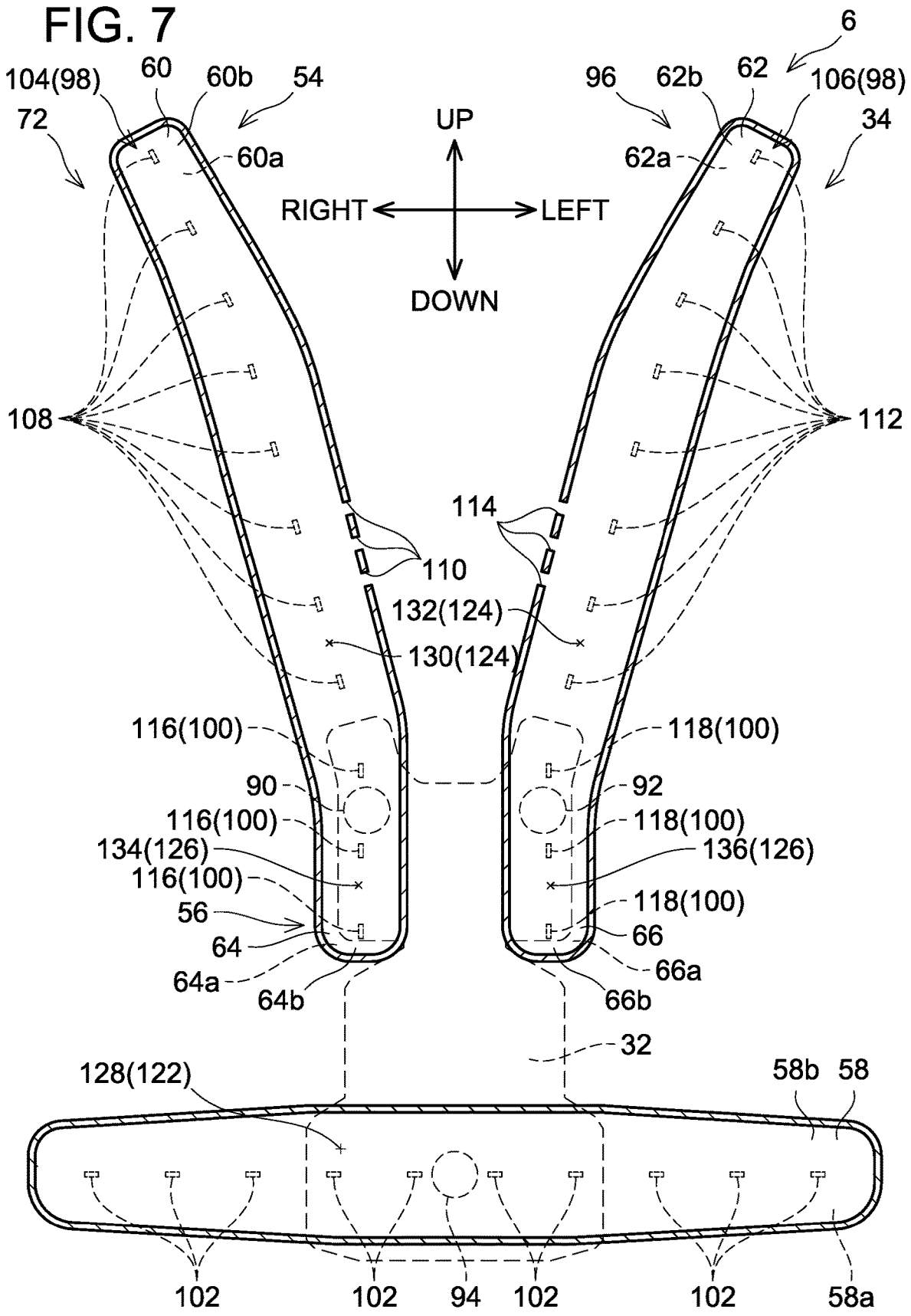
FIG. 7 is a cross-sectional view of a harness 34 of the first embodiment in the state where the shoulder belts 54 and the waist belt 58 are spread open.

The three second right shoulder cooling ports 110 shown in FIG. 7 are disposed in vicinity of a boundary between the contact surface 60*a* (see FIG. 6) and a non-contacting surface 60*b* of the right shoulder belt 60. The non-contacting surface 60*b* of the right shoulder belt 60 is a surface that does not contact the user's right shoulder when the right shoulder belt 60 is worn on the user's right shoulder, and is a surface on an opposite side from the contact surface 60*a* of the right shoulder belt 60. The three second right shoulder cooling ports 110 are arranged in a line along the longitudinal direction of the right shoulder belt 60. When the right shoulder belt 60 is worn on the user's right shoulder, the three second right shoulder cooling ports 110 face the user's face or neck in vicinity of the user's right shoulder.

As shown in FIG. 6, the left shoulder cooling ports 106 are disposed on the left shoulder belt 62. The one or more left shoulder cooling ports 106 include one or more first left shoulder cooling ports 112 (eight in the present embodiment) and one or more second left shoulder cooling ports 114 (three in the present embodiment; see FIG. 7). The eight first left shoulder cooling ports 112 are disposed on the contact surface 62*a* of the left shoulder belt 62. The eight first left shoulder cooling ports 112 are arranged in a line along the longitudinal direction of the contact surface 62*a* of the left shoulder belt 62. When the left shoulder belt 62 is worn on the user's left shoulder, the eight first left shoulder cooling ports 112 face the user's left shoulder in vicinity of the user's left shoulder.

The three second left shoulder cooling ports 114 shown in FIG. 7 are disposed in vicinity of a boundary between the contact surface 62*a* (see FIG. 6) and a non-contacting surface 62*b* of the left shoulder belt 62. The non-contacting surface 62*b* of the left shoulder belt 62 is a surface that does not contact the user's left shoulder when the left shoulder belt 62 is worn on the user's left shoulder, and is a surface on an opposite side from the contact surface 62*a* of the left shoulder belt 62. The three second left shoulder cooling ports 114 are arranged in a line along the longitudinal direction of the left shoulder belt 62. When the left shoulder belt 62 is worn on the user's left shoulder, the three second left shoulder cooling ports 114 face the user's face or neck in vicinity of the user's left shoulder.

As shown in FIG. 6, the one or more back cooling ports 100 include one or more right back cooling ports 116 (three in the present embodiment) and one or more left back cooling ports 118 (three in the present embodiment). The three right back cooling ports 116 are disposed on the contact surface 64*a* of the right back pad 64. The three right back cooling ports 116 are arranged in a line along the longitudinal direction of the contact surface 64*a* of the right back pad 64. When the right back pad 64 is in contact with the user's back, the three right back cooling ports 116 face the user's back in vicinity of the user's back.

The three left back cooling ports 118 are disposed on the contact surface 66*a* of the left back pad 66. The three left back cooling ports 118 are arranged in a line along the longitudinal direction of the contact surface 66*a* of the left back pad 66. When the left back pad 66 is in contact with the user's back, the three left back cooling ports 118 face the user's back in vicinity of the user's back.

The ten waist cooling ports 102 are disposed on the contact surface 58*a* of the waist belt 58. The ten waist cooling ports 102 are arranged in a line along the longitudinal direction of the contact surface 58*a* of the waist belt 58. When the waist belt 58 is worn on the user's waist, the ten waist cooling ports 102 face the user's waist in vicinity of the user's waist.

As shown in FIG. 7, the cooling structure 72 further comprises an air passage 122. Cooling air flows in the air passage 122 by the operation of the cooling fan 14. The air passage 122 includes one or more shoulder air passages 124, one or more back air passages 126, and one or more waist cooling passages 128 (one in the present embodiment).

The one or more shoulder air passages 124 include one or more right shoulder air passages 130 (one in the present embodiment) and one or more left shoulder air passages 132 (one in the present embodiment). The right shoulder air passage 130 is defined inside the right shoulder belt 60. The right shoulder air passage 130 communicates with outside of the right shoulder belt 60 through the plurality of right shoulder cooling ports 104. The left shoulder air passage 132 is defined inside the left shoulder belt 62. The left shoulder air passage 132 communicates with outside of the left shoulder belt 62 through the plurality of left shoulder cooling ports 106.

The one or more back air passages 126 include one or more right back air passage 134 (one in the present embodiment) and one or more left back air passage 136 (one in the present embodiment). The right back air passage 134 is defined inside the right back pad 64. The right back air passage 134 communicates with outside of the right back pad 64 through the three right back cooling ports 116. Further, the right back air passage 134 communicates with the right shoulder air passage 130. Further, the right back air passage 134 communicates with the body passage 74 (see FIG. 5) through the harness communication hole 90, the back plate communication hole 84 (see FIG. 3), and the body communication hole 78 (see FIG. 5). The left back air passage 136 is defined inside the left back pad 66. The left back air passage 136 communicates with outside of the left back pad 66 through the three left back cooling ports 118. Further, the left back air passage 136 communicates with the left shoulder air passage 132. Further, the left back air passage 136 communicates with the body passage 74 (see FIG. 5) through the harness communication hole 92, the back plate communication hole 86 (see FIG. 3), and the body communication hole 80 (see FIG. 5).

The waist cooling passage 128 is defined inside the waist belt 58. The waist cooling passage 128 communicates with outside of the waist belt 58 through the ten waist cooling ports 102. Further, the waist cooling passage 128 communicates with the body passage 74 (see FIG. 5) through the harness communication hole 94, the back plate communication hole 82 (see FIG. 3), and the body communication hole 76 (see FIG. 5).

Next, a method of cooling the user's body by the operation of the cooling fan 14 will be described. Firstly, a case in which the cooling air flows out from the plurality of cooling ports 96 by the operation of the cooling fan 14 will be described. When the user operates the shifter switch 26 (see FIG. 4) of the operating part 16 in the state of wearing the backpack-type assembly 2 (see FIG. 1) on his/her back and the cooling fan 14 shown in FIG. 5 thereby switch to the ON state, the cooling fan 14 starts operating. As shown in FIG. 5, when the cooling fan 14 operates, the cooling air fed out from the cooling fan 14 flows from outside the body 4 into the body passage 74 through the cooling fan 14. The cooling air that flowed in flows to the body communication holes 76, 78, 80.

The cooling air that flowed to the body communication hole 76 flows from the body passage 74 into the waist cooling passage 128 in the waist belt 58 (see FIG. 7) through the body communication hole 76 and the back plate communication hole 82 (see FIG. 3). As shown in FIG. 7, the cooling air that flowed in flows in the waist cooling passage 128, and flows out to the outside of the waist belt 58 from the ten waist cooling ports 102. The air that flowed out flows along the surface of the user's waist and thereby cools the user's waist. Since the waist belt 58 is constituted of the breathable fabric material, moisture in vicinity of the waist belt 58 is ventilated as the cooling air flows in the waist cooling passage 128, thus the moisture on the user's waist is reduced. Further, when the cooling air flows in the waist cooling passage 128, the waist belt 58 is thereby cooled, and this reduces the heat that the user may be feeling.

As shown in FIG. 5, the cooling air that flowed to the body communication hole 78 flows from the body passage 74 into the right back air passage 134 in the right back pad 64 (see FIG. 7) through the body communication hole 78, the back plate communication hole 84 (see FIG. 3), and the harness communication hole 90 (see FIG. 7). As shown in FIG. 7, a part of the cooling air that flowed in flows back out to the outside of the right back pad 64 from the three right back cooling ports 116 as the cooling air flows in the right back air passage 134. The cooling air that flowed out flows along the surface of the user's back and thereby cools the user's back. Remainder of the cooling air flowing in the right back air passage 134 flows from the right back air passage 134 into the right shoulder air passage 130. The cooling air flows out to the outside of the right shoulder belt 60 from the eight first right shoulder cooling ports 108 and also from the three second right shoulder cooling ports 110. The cooling air that flowed out through the eight first right shoulder cooling ports 108 flows along the surface of the user's right shoulder and cools the user's right shoulder. The cooling air that flowed out from the second right shoulder cooling ports 110 flows along the surface of the user's face or neck and cools the user's face or neck. Since the right back pad 64 and the right shoulder belt 60 are constituted of the breathable fabric material, moisture in vicinities of the right back pad 64 and the right shoulder belt 60 is ventilated as the cooling air flows in the right back air passage 134 and the right shoulder air passage 130, thus the moisture on the user's right shoulder and back is reduced. Further, when the cooling air flows in the right back air passage 134 and the right shoulder air passage 130, the right back pad 64 and the right shoulder belt 60 are thereby cooled, and this reduces the heat that the user may be feeling.

As shown in FIG. 5, the cooling air that flowed to the body communication hole 80 flows from the body passage 74 to the left back air passage 136 in the left back pad 66 (see FIG. 7) through the body communication hole 80, the back plate communication hole 86 (see FIG. 3), and the harness communication hole 92 (see FIG. 7). As shown in FIG. 7, a part of the cooling air that flowed in flows back out to the outside of the left back pad 66 from the three left back cooling ports 118 as the cooling air flows in the left back air passage 136. The cooling air that flowed out flows along the surface of the user's back and thereby cools the user's back. Remainder of the cooling air flowing in the left back air passage 136 flows from the left back air passage 136 into the left shoulder air passage 132. The cooling air flows out to the outside of the left shoulder belt 62 from the eight first left shoulder cooling ports 112 and also from the three second left shoulder cooling ports 114. The cooling air that flowed out through the eight first left shoulder cooling ports 112 flows along the surface of the user's left shoulder and cools the user's left shoulder. The cooling air that flowed out from the second left shoulder cooling ports 114 flows along the surface of the user's face or neck and cools the user's face or neck. Since the left back pad 66 and the left shoulder belt 62 are constituted of the breathable fabric material, moisture in vicinities of the left back pad 66 and the left shoulder belt 62 is ventilated as the cooling air flows in the left back air passage 136 and the left shoulder air passage 132, thus the moisture on the user's left shoulder and back is reduced. Further, when the cooling air flows in the left back air passage 136 and the left shoulder air passage 132, the left back pad 66 and the left shoulder belt 62 are thereby cooled, and this reduces the heat that the user may be feeling.

Next, a case in which the cooling air flows in from the plurality of cooling ports 96 by the operation of the cooling fan 14 will be described. As shown in FIG. 7, when the cooling fan 14 (see FIG. 5) operates, the cooling air flows from the vicinity of the user's waist into the waist cooling passage 128 through the ten waist cooling ports 102. At this occasion, the cooling air flows along the surface of the user's waist, and cools the user's waist. The cooling air flows in the waist cooling passage 128, and thereafter flows from the waist cooling passage 128 into the body passage 74 in the body 4 (see FIG. 5) through the harness communication hole 94, the back plate communication hole 82 (see FIG. 3), and the body communication hole 76 (see FIG. 5).

Further, when the cooling fan 14 (see FIG. 5) operates, the cooling air flows from the vicinity of the user's right shoulder into the right shoulder air passage 130 through the eight first right shoulder cooling ports 108, and flows to the right back air passage 134. At this occasion, the cooling air flows along the surface of the user's right shoulder and cools the user's right shoulder. Further, the cooling air flows from the vicinity of the user's face or neck into the right shoulder air passage 130 through the three second right shoulder cooling ports 110, and flows to the right back air passage 134. At this occasion, the cooling air flows along the surface of the user's face or neck and cools the user's face or neck. Further, the cooling air flows from the vicinity of the user's back into the right back air passage 134 through the three right back cooling ports 116. At this occasion, the cooling air flows along the surface of the user's back and cools the user's back. The cooling air flows in the right back air passage 134, and thereafter flows from the right back air passage 134 into the body passage 74 of the body 4 (see FIG. 5) through the harness communication hole 90, the back plate communication hole 84 (see FIG. 3), and the body communication hole 78 (see FIG. 5).

Further, when the cooling fan 14 (see FIG. 5) operates, the cooling air flows from the vicinity of the user's left shoulder into the left shoulder air passage 132 through the eight first left shoulder cooling ports 112, and flows to the left back air passage 136. At this occasion, the cooling air flows along the surface of the user's left shoulder and cools the user's left shoulder. Further, the cooling air flows from the vicinity of the user's face or neck into the left shoulder air passage 132 through the three second left shoulder cooling ports 114, and flows to the left back air passage 136. At this occasion, the cooling air flows along the surface of the user's face or neck and cools the user's face or neck. Further, the cooling air flows from the vicinity of the user's back into the left back air passage 136 through the three left back cooling ports 118. At this occasion, the cooling air flows along the surface of the user's back and cools the user's back. The cooling air flows in the left back air passage 136, and thereafter flows from the left back air passage 136 into the body passage 74 of the body 4 (see FIG. 5) through the harness communication hole 92, the back plate communication hole 86 (see FIG. 3), and the body communication hole 80 (see FIG. 5).

As shown in FIG. 5, all the air that flowed into the body passage 74 flows in the body passage 74 and is thereafter fed out by the cooling fan 14, and flows out to the outside of the body 4.

(Effects)

In the present embodiment, the backpack-type assembly 2 comprises the body 4 and the base member 6. The body 4 comprises the cooling fan 14. The base member 6 comprises the back plate 32 attached to the body 4, and the harness 34 attached to the back plate 32 and configured to be worn on the user. The harness 34 comprises the cooling ports 96 and at least one shoulder belt 54 configured to be worn on the user's shoulder. The cooling fan 14 is configured to circulate the cooling air through the cooling ports 96 of the base member 6.

According to the above configuration, the user's body can be cooled by operating the cooling fan 14 while the user is wearing the backpack-type assembly 2 on his/her back. Due to this, an occurrence of a situation in which the user feels heat while the user is wearing the backpack-type assembly 2 on his/her back can be suppressed.

Further, the cooling ports 96 are disposed in the vicinity of the user when the user wears the harness 34.

According to the above configuration, when the cooling air circulates through the cooling ports 96, the cooling air flows in the vicinity of the user's body. Due to this, the occurrence of the situation in which the user feels heat while the user is wearing the backpack-type assembly 2 on his/her back can further be suppressed.

Further, the cooling ports 96 face the user when the user wears the harness 34.

According to the above configuration, when the cooling air circulates through the cooling ports 96, the cooling air flows along user's body surface. Due to this, the occurrence of the situation in which the user feels heat while the user is wearing the backpack-type assembly 2 on his/her back can further be suppressed.

Further, the harness 34 further comprises the back pads 56 configured to be in contact with the user's back when the user wears the harness 34. The cooling ports 96 face portions of the user's back in contact with the back pads 56 when the user wears the harness 34.

When the harness 34 comprises the back pads 56, heat easily builds up on the user's back due to the back pads 56 being in contact with the user's back. According to the above configuration, when the cooling air circulates through the cooling ports 96, the cooling air flows along the surfaces of the portions of the user's back that are in contact with the back pads 56. Due to this, the occurrence of the situation in which the user feels heat while the user is wearing the backpack-type assembly 2 on his/her back can further be suppressed.

Further, the cooling ports 96 are disposed on the shoulder belts 54.

When the user wears the backpack-type assembly 2 on his/her back, heat easily builds up on the user's shoulders since the shoulder belts 54 contact the user's shoulders. According to the above configuration, when the cooling air circulates through the shoulder cooling ports 96, the cooling air flows along the surfaces of the user's shoulders. Due to this, the occurrence of the situation in which the user feels heat while the user is wearing the backpack-type assembly 2 on his/her back can further be suppressed.

Further, the harness 34 further comprises the waist belt 58 configured to be worn on the user's waist. The cooling ports 96 are disposed on the waist belt 58.

When the harness 34 comprises the waist belt 58, the waist belt 58 comes into contact with the user's waist. Due to this, heat may easily build up on the user's waist. According to the above configuration, when the cooling air circulates through the cooling ports 96, the cooling air flows along the surface of the user's waist. Due to this, the occurrence of the situation in which the user feels heat while the user is wearing the backpack-type assembly 2 on his/her back can further be suppressed.

Further, the harness 34 may further comprise the waist belt 58 configured to be worn on the user's waist and the cooling ports 96 disposed on the waist belt 58. The cooling fan 14 circulates the cooling air through the cooling ports 96 disposed on the shoulder belt 54 and the cooling ports 96 disposed on the waist belt 58.

When the harness 34 comprises the waist belt 58, the waist belt 58 comes into contact with the user's waist. Due to this, heat may easily build up on the user's waist. According to the above configuration, when the cooling air circulates through the cooling ports 96 disposed on the waist belt 58, the cooling air flows along the surface of the user's waist. Due to this, the occurrence of the situation in which the user feels heat while the user is wearing the backpack-type assembly 2 on his/her back can further be suppressed.

Further, the body 4 comprises the battery 12 that supplies electrical power to the cooling fan 14.

According to the above configuration, the cooling fan 14 can be operated even when the backpack-type assembly 2 does not have the external power supply that supplies electrical power to the cooling fan 14.

Further, the body 4 is configured to be connected to the electrical working machine having the motor. The battery 12 is configured to supply electrical power to the motor of the electrical working machine.

According to the above configuration, the occurrence of the situation in which the user feels heat while the user is wearing the backpack-type assembly 2 which supplies electrical power to the electrical working machine can be suppressed.

Further, the cooling fan 14 is configured so that the flow rate is adjustable.

According to the above configuration, the flow rate of the cooling fan 14 can be adjusted in accordance with the degree of heat which the user feels.

Further, the body 4 comprises the operating part 16 configured to control the operation of the cooling fan 14.

According to the above configuration, the user can control the operation of the cooling fan 14 by using the operating part 16.

Further, the operating part 16 comprises the shifter switch 26 configured to switch the ON state and the OFF state of the cooling fan 14.

According to the above configuration, the user can cause the cooling fan 14 to operate by manipulating the shifter switch 26 when the user wishes to cause the cooling fan 14 to operate.

Further, the cooling fan 14 is configured so that its flow rate is adjustable. The operating part 16 comprises the flow rate adjusting switch 28 configured to adjust the flow rate of the cooling fan 14.

According to the above configuration, the user can adjust the flow rate of the cooling fan 14 to a desired flow rate by manipulating the flow rate adjusting switch 28.

Further, the harness 34 comprises the air passage 122 communicated with the cooling ports 96. When the cooling fan 14 operates, the cooling air flows in the air passage 122.

According to the above configuration, the harness 34 can be cooled by the cooling air flowing in the air passage 122. Due to this, the occurrence of the situation in which the user feels heat while the user is wearing the backpack-type assembly 2 on his/her back can further be suppressed.

Second Embodiment

A second embodiment will be described with reference to FIGS. 8 and 9. In the second embodiment, features that differ from the first embodiment will be described, and features that are same as the first embodiment will be given the same reference signs and description thereof will be omitted. In the second embodiment, arrangements of three right back cooling ports 116, three left back cooling ports 118, and four waist cooling ports 102 among the plurality of waist cooling ports 102 differ from those of the first embodiment. Hereinbelow, the four waist cooling ports 102 among the plurality of waist cooling ports 102 will be termed center waist cooling ports 202.

Figure 8:
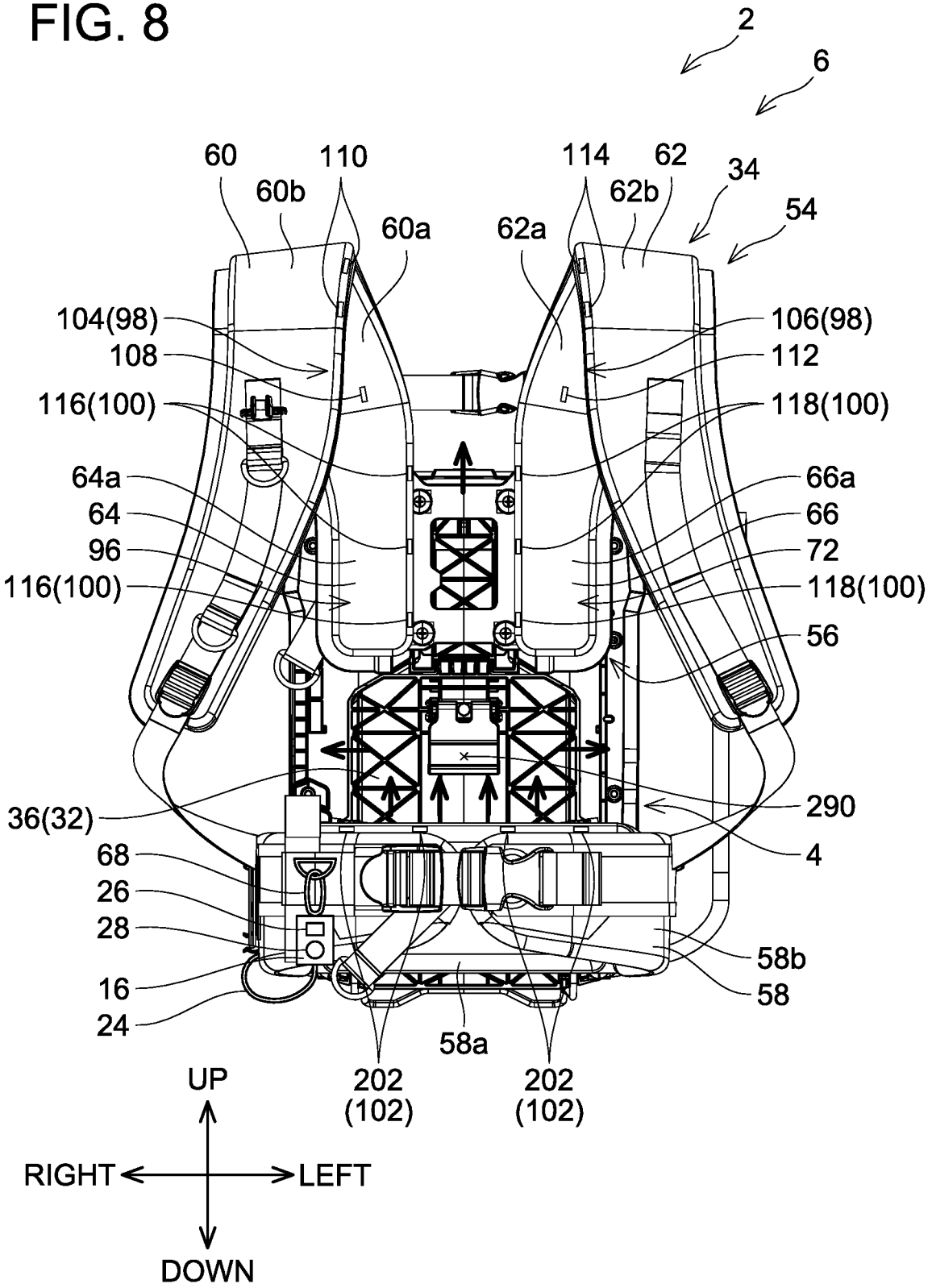
FIG. 8 is a front view of a base member 6 of a second embodiment.
Figure 9:
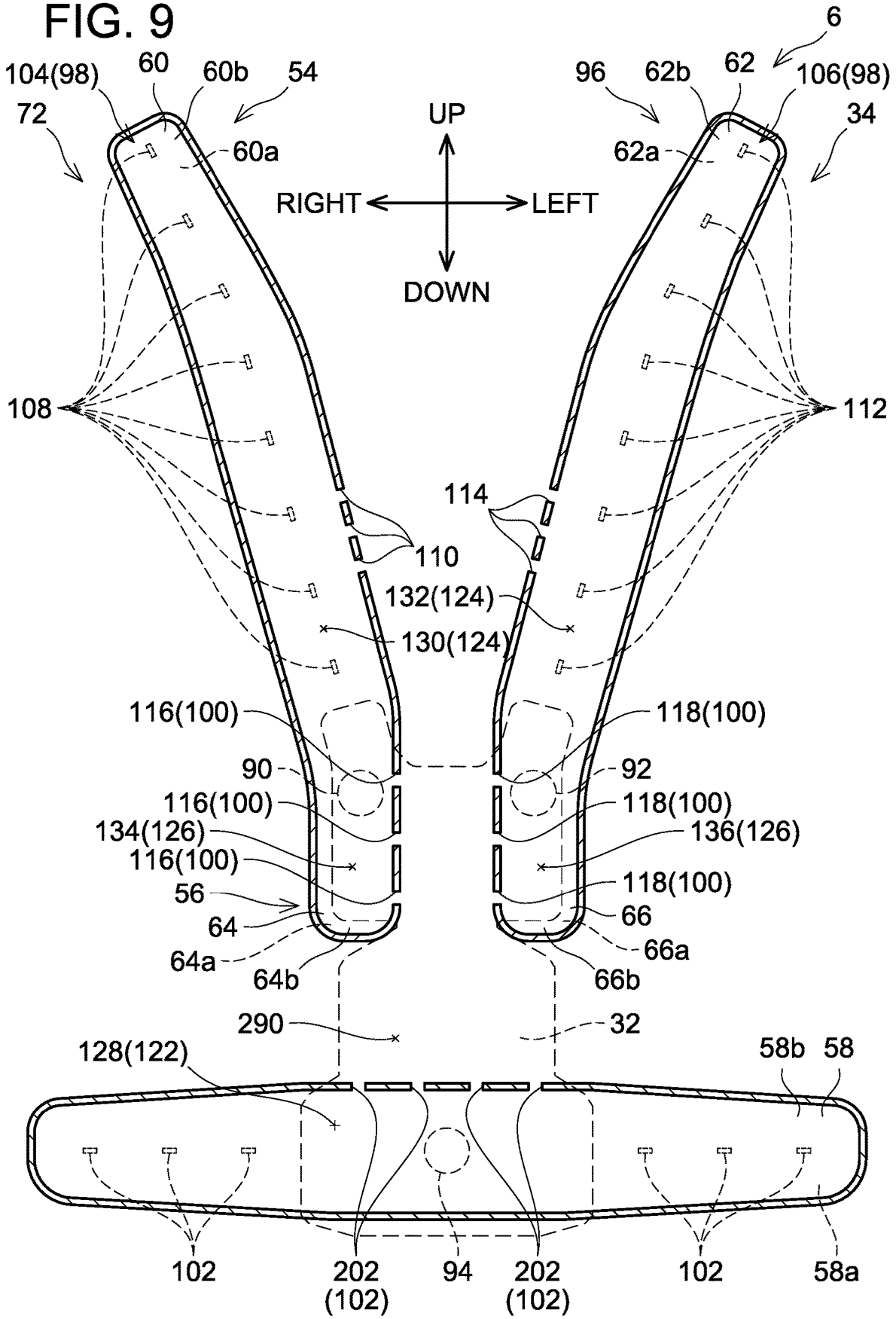
FIG. 9 is a cross-sectional view of a harness 34 of the second embodiment in a state where shoulder belts 54 and a waist belt 58 are spread open.

The three right back cooling ports 116 shown in FIG. 8 are disposed in vicinity of a boundary between the contact surface 64*a* and a non-contacting surface 64*b* of the right back pad 64 (see FIG. 9). The three right back cooling ports 116 are disposed at a left end of the right back pad 64.

The three left back cooling ports 118 are disposed in vicinity of a boundary between the contact surface 66*a* and a non-contacting surface 66*b* of the left back pad 66 (see FIG. 9). The three left back cooling ports 118 are disposed at a right end of the left back pad 66. Each of the three left back cooling ports 118 faces its corresponding one of the three right back cooling ports 116.

The four center waist cooling ports 202 shown in FIG. 9 are disposed in vicinity of a boundary between the contact surface 58*a* and the non-contacting surface 58*b* of the waist belt 58 (see FIG. 8). The four center waist cooling ports 202 are disposed at an upper end of the waist belt 58.

As shown in FIG. 8, a non-contacting space 290 is defined between the right back pad 64 and the left back pad 66 (being a space along the left-right direction) and between the back pads 56 and the waist belt 58 (being a space along the up-down direction). When the harness 34 is worn by the user, the non-contacting space 290 is disposed between the user's back and the back plate 32. Further, when the harness 34 is worn by the user, the back pads 56 and the waist belt 58 are not disposed in the non-contacting space 290. When the harness 34 is worn by the user, the three right back cooling ports 116, the three left back cooling ports 118, and the four center waist cooling ports 202 all face the non-contacting space 290.

Next, the method of cooling the user's body by the operation of the cooling fan 14 (see FIG. 5) will be described. Hereinbelow, only the flow of the cooling air flowing through the three right back cooling ports 116, the three left back cooling ports 118, and the four center waist cooling ports 202 will be described. Firstly, the case in which the cooling air flows out from the plurality of cooling ports 96 by the operation of the cooling fan 14 will be described. In FIG. 8, directions of the flow of the cooling air are partly indicated by arrows. After the cooling air flowed in the right back air passage 134 inside the right back pad 64

(see FIG. 9) by the operation of the cooling fan 14, the cooling air flows out to the non-contacting space 290 through the three right back cooling ports 116. Further, after the cooling air flowed in the left back air passage 136 inside the left back pad 66 (see FIG. 9), the cooling air flows out to the non-contacting space 290 through the three left back cooling ports 118. Furthermore, after the cooling air flowed in the waist cooling passage 128 inside the waist belt 58 (see FIG. 9), the cooling air flows out to the non-contacting space 290 through the four center waist cooling ports 202. The cooling air that flowed out flows along the surface of the user's back as it flows in the non-contacting space 290, and thereby cools the user's back. After this, the cooling air flows in the directions of the arrows of FIG. 8, and flows out to the space outside the non-contacting space 290.

Next, the case in which the cooling air flows in from the plurality of cooling ports 96 by the operation of the cooling fan 14 will be described. When the cooling fan 14 operates, the cooling air flows in directions opposite to the arrows in FIG. 8, and flows into the non-contacting space 290 from the space outside the non-contacting space 290. The cooling air that flowed in flows along the surface of the user's back as it flows in the non-contacting space 290 and cools the user's back. After this, the cooling air flows into the right back air passage 134 (see FIG. 9) through the three right back cooling ports 116. Further, the cooling air flows into the left back air passage 136 (see FIG. 9) through the three left back cooling ports 118. Furthermore, the cooling air flows into the waist cooling passage 128 (see FIG. 9) through the four center waist cooling ports 202.

(Effects)

In the present embodiment, the harness 34 further comprises the back pads 56 that contact the user's back when the user wears the harness 34. When the user wears the harness 34, the non-contacting space 290 in which the back pads 56 are not disposed is defined between the user's back and the back plate 32. The cooling ports 96 face the non-contacting space 290 when the user wears the harness 34.

When the harness 34 comprises the back pads 56, heat easily builds up on the user's back due to the back pads 56 being in contact with the user's back. According to the above configuration, when the cooling air circulates through the cooling ports 96, the cooling air flows along the surface of the user's back in the non-contacting space 290. Due to this, the occurrence of the situation in which the user feels heat while the user is wearing the backpack-type assembly 2 on his/her back can further be suppressed.

Third Embodiment

Figure 10:
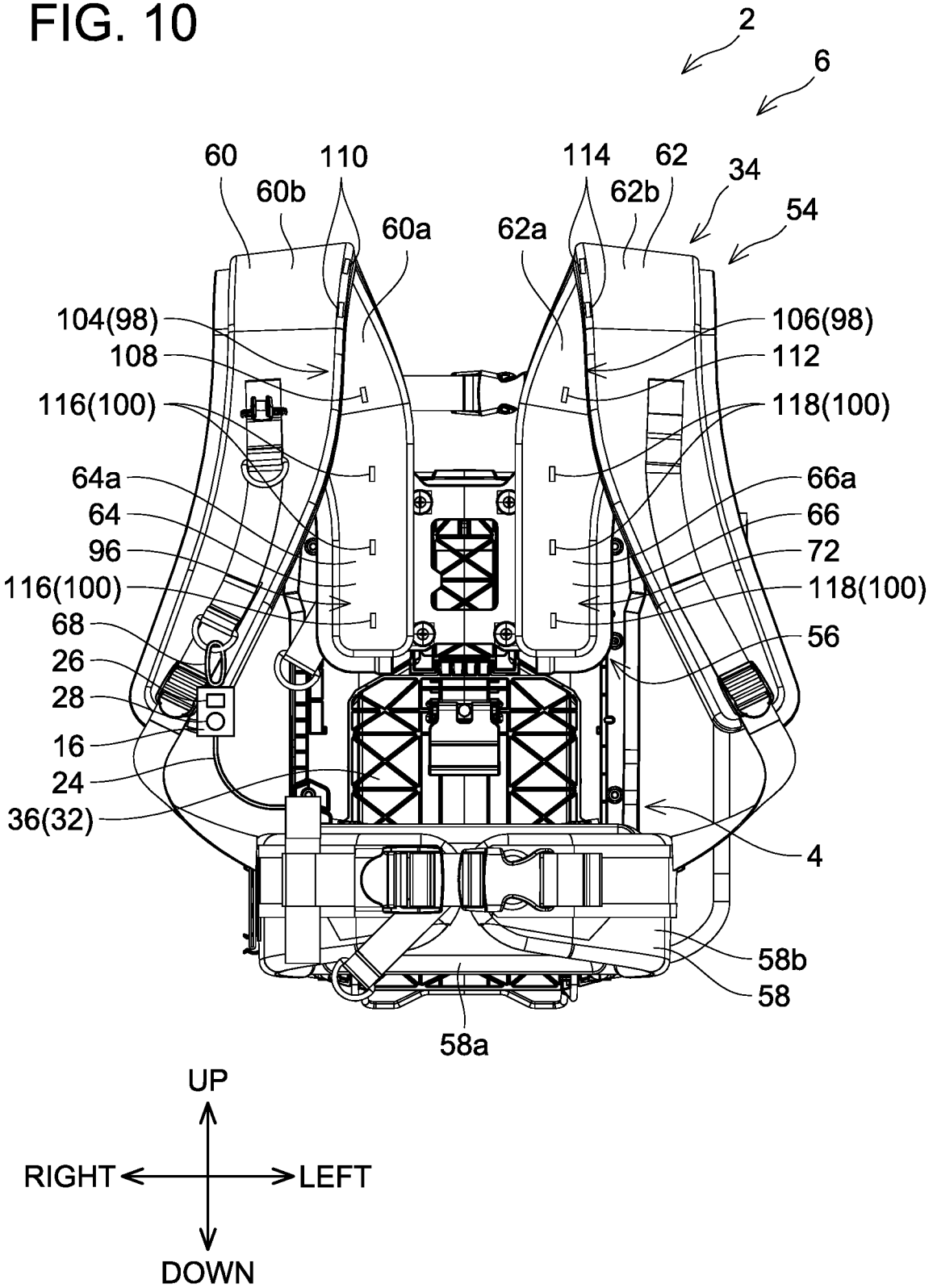
FIG. 10 is a front view of a base member 6 of a third embodiment.

A third embodiment will be described with reference to FIG. 10. In the third embodiment, features that differ from the first embodiment will be described, and features that are same as the first embodiment will be given the same reference signs and description thereof will be omitted. In the third embodiment, a location where the operating part 16 is attached on the body 4 differs from that of the first embodiment.

The operating part 16 is detachably attached to the right shoulder belt 60 via the buckle 68. In this case, the user operates the shifter switch 26 and the flow rate adjusting switch 28 by his/her left hand, for example. In a variant, the operating part 16 may be detachably attached to the left shoulder belt 62 via a buckle 68.

(Variants)

In an embodiment, the body 4 may be integrated with the back plate 32.

In an embodiment, the body 4 may be a working machine. The body 4 may for example be a dust collector, a blower, or a mist blower.

In an embodiment, the right shoulder belt 60 and the right back pad 64 may be separate members. Further, the left shoulder belt 62 and the left back pad 66 may be separate members.

In an embodiment, the right, shoulder belt 60 and the left shoulder belt 62 may be integrated. Further, the right back pad 64 and the left back pad 66 may be integrated.

In an embodiment, the air passage 122 may include therein a buffer material capable of allowing air to flow therethrough such as a sponge or a cotton.

In an embodiment, the waist belt 58, the right shoulder belt 60, the left shoulder belt 62, the right back pad 64, and the left back pad 66 may be integrated.

In an embodiment, the cooling structure 72 may comprise another cooling fan(s). This other cooling fan(s) may be disposed on one/both of the shoulder belts 54, or may be disposed on the waist belt 58.

In an embodiment, the backpack-type assembly 2 may comprise an attachment that houses the operating part 16. In this case, the attachment may be detachably attached to one of the shoulder belts 54, or may be detachably attached to the waist belt 58 or the body 4.

In an embodiment, the flow rate adjusting switch 28 may be configured with a rhythmic operation mode configured to automatically switch between the HIGH mode and the LOW mode.

In an embodiment, the plurality of cooling ports 96 may comprise only the one or more shoulder cooling ports 98, the one or more back cooling ports 100, or the one or more waist cooling ports 102, or only a combination of two of the aforementioned ports.

In an embodiment, the shifter switch 26 and the flow rate adjusting switch 28 may be disposed on the body 4 (such as on the body casing 8).

What is claimed is:

1. A backpack-type assembly comprising:

a body; and a base member, wherein the body comprises:

a body casing; and a cooling fan attached to the body casing, the body casing includes:

a body passage defined inside the body casing and extending from the cooling fan;

a first communication hole disposed on the body passage; and a second communication hole disposed on the body passage, the base member comprises:

a back plate attached to the body; and a harness attached to the back plate and configured to be worn on a user, the harness comprises:

at least one shoulder belt comprising a shoulder air passage, communicating with the first communication hole, defined therein and configured to be worn on a shoulder of the user, a waist belt comprising a waist air passage, communicating with the second communication hole, defined therein and configured to be worn on a waist of the user;

a shoulder cooling port disposed on the at least one shoulder belt and communicating the shoulder air passage to outside the at least one shoulder belt; and a waist cooling port disposed on the waist belt and communicating the waist air passage to outside the waist belt, the cooling fan is configured to circulate cooling air into or out of the base member through the shoulder cooling port and the waist cooling port, the body casing further includes:

a front surface facing a back of the user when the user wears the harness; and a side surface perpendicular to the front surface, and the cooling fan is attached to the side surface of the body casing.

2. The backpack-type assembly according to claim 1, wherein at least of the shoulder cooling port and the waist cooling port is disposed in the vicinity of the user when the user wears the harness.

3. The backpack-type assembly according to claim 1, wherein at least one of the shoulder cooling port and the waist cooling port faces the user when the user wears the harness.

4. The backpack-type assembly according to claim 1, wherein the harness further comprises a back pad configured to be in contact with a back of the user when the user wears the harness, the back pad includes a back cooling port, and the back cooling port faces a portion of the back of the user being in contact with the back pad when the user wears the harness.

5. The backpack-type assembly according to claim 1, wherein the harness further comprises a back pad configured to be in contact with a back of the user when the user wears the harness, the back pad includes a back cooling port, a non-contacting space is defined between the back of the user and the back plate when the user wears the harness, the non-contacting space being a space in which the back pad is not disposed, and the back cooling port faces the non-contacting space when the user wears the harness.

6. The backpack-type assembly according to claim 1, wherein the body comprises a battery configured to supply electrical power to the cooling fan.

7. The backpack-type assembly according to claim 6, wherein the body is configured to be connected to an electrical working machine comprising a motor, and the battery is configured to supply electrical power to the motor of the electrical working machine.

8. The backpack-type assembly according to claim 1, wherein the cooling fan is configured so that a flow rate of the cooling fan is adjustable.

9. The backpack-type assembly according to claim 1, wherein the body comprises an operating part configured to operate the cooling fan.

10. The backpack-type assembly according to claim 9, wherein the operating part comprises a shifter switch configured to switch an OFF state and an ON state of the cooling fan.

11. The backpack-type assembly according to claim 9, wherein the cooling fan is configured so that a flow rate of the cooling fan is adjustable, and the operating part comprises a flow rate adjusting switch configured to adjust the flow rate of the cooling fan.

* * * * *